US005910285A

United States Patent [19]

Zhao

[11] Patent Number: 5,910,285

[45] Date of Patent: Jun. 8, 1999

[54] AUSTENITIC ACID CORROSION-RESISTANT STAINLESS STEEL OF AL-MN-SI-N SERIES

[76] Inventor: Xuesheng Zhao, No. 001, Entrance 5, Bldg. 1, Jingjidao Residential District, Xicheng District, Beijing 100032, China

[21] Appl. No.: 09/029,049

[22] PCT Filed: Aug. 14, 1996

[86] PCT No.: PCT/CN96/00064

§ 371 Date: Feb. 18, 1998

§ 102(e) Date: Feb. 18, 1998

[87] PCT Pub. No.: WO97/07253

PCT Pub. Date: Feb. 27, 1997

[30] Foreign Application Priority Data

Aug. 18, 1995 [CN] China ..... 95116318

[51] Int. Cl.[6] ..... C22C 38/04; C22C 38/06

[52] U.S. Cl. ..... 420/72; 420/74; 420/73; 420/75

[58] Field of Search ..... 420/73, 74, 72, 420/75

[56] References Cited

U.S. PATENT DOCUMENTS 3,690,870 9/1972 Williams .

4,875,933 10/1989 Wan ..... 420/73

FOREIGN PATENT DOCUMENTS 85105573 7/1986 Japan .

92115266 6/1994 Japan .

*Primary Examiner*—Deborah Yee

*Attorney, Agent, or Firm*—Sughrue, Mion, Zinn, Macpeak & Seas, PLLC

[57] ABSTRACT

The invention relates to an Al—Mn—Si—N stainless acid-resisting steel substantially free of both Cr and Ni elements, which comprises the following elements: 0.06–0.12 C, 4–5 Al, 16–18 Mn, 1.2–1.5 Si, 0.15–0.30 N, 0.1–0.2 Re and the balance Fe. The corrosion resistance and mechanical properties of the steel can be further improved by adding a small amount of element(s) selected from the group consisting of Cr, Ni, Co, Ti, Nb, Cu, Mo, Zr, Hf, W and the like. The stainless steel has good corrosion resistance, pressure processing characteristics and welding performance, which can be made into a variety of stainless steel product and can be used in a broad field.

12 Claims, No Drawings

AUSTENITIC ACID CORROSION-RESISTANT STAINLESS STEEL OF AL-MN-SI-N SERIES

TECHNICAL FIELD

The invention relates to an Al—Mn—Si—N austenitic stainless acid-resisting steel, which can be used to substitute for conventional 18-8 type austenitic stainless steel.

BACKGROUND OF THE INVENTION 18-8 type austenitic stainless steel, such as 1Cr18Ni9, 1Cr18Ni9Ti and 0Cr18Ni9 belongs to conventional austenitic stainless steel. It has found a extensive and long-term application in the industry because of its superior corrosion resistance, combined mechanical properties and processing property. However, because it contains a large amount of expensive Cr and Ni, the price of the steel is very high, thereby limiting its application in a broader field. Furthermore, because both Cr and Ni are scarce in the earth, it is a long-term goal of metallurgical field to develop an austenitic stainless steel containing little or no Cr, Ni so as to substitute for 18-8 type Cr-Ni austenitic stainless steel. Up to now, however, it has not been reported that a stainless steel without Cr and Ni can provide corrosion resistance, combined mechanical properties and processing property equivalent to that by conventional 18-8 type Cr-Ni austenitic stainless steel.

It is a main object of the invention to provide an Al—Mn—Si—N austenitic stainless acid-resisting steel.

It is another object of the invention to provide an Al—Mn—Si—N austenitic stainless acid-resisting steel which can improve corrosion resistance, especially in sulfinic acid or a reductive medium.

It is again another object of the invention to provide an Al—Mn—Si—N austenitic stainless acid-resisting steel which is in particularly resistant to intergranular-corrosion.

It is a further object of the invention to provide an Al—Mn—Si—N austenitic stainless acid-resisting steel which has an improved toughness at a low temperature, especially at the temperature of −120° C.

It is a further object of the invention to provide an Al—Mn—Si—N austenitic stainless acid-resisting steel which has an improved corrosion resistance in hydrochoric acid, diluted sulfuric acid, basic solution and seawater.

It is a further object of the invention to provide an Al—Mn—Si—N austenitic stainless acid-resisting steel which has an improved resistances to oxidation, heat fatigue and hot corrosion.

It is a further object of the invention to provide an Al—Mn—Si—N austenitic stainless acid-resisting steel which has an improved resistances to wear and high temperature.

SUMMARY OF THE INVENTION

The technical solution of the invention is achieved as follows (all contents hereafter are percentage by weight of the steel, unless otherwise specified):

An Al—Mn—Si—N austenitic stainless acid-resisting steel according to one embodiment of the invention comprises the following elements: 0.06–0.12 C, 4–5 Al, 16–18 Mn, 1.2–1.5 Si, 0.15–0.3 N, 0.1–0.2 rare metal(s), the balance Fe and unavoidable impurities.

An Al—Mn—Si—N austenitic stainless acid-resisting steel resistant to intergranular-corrosion according to another embodiment of the invention contains 0.06–0.12 C, 4–Al, 16–18 Mn, 1.2–1.5 Si, 0.15–0.3 N. 0.1–0.2 rare metal(s), 1–3 Ti, the balance Fe and unavoidable impurities.

An Al—Mn—Si—N austenitic stainless acid-resisting steel resistant to intergranular-corrosion according to one embodiment of the invention contains 0.06–0.12 C, 4–5 Al, 16–18 Mn, 1.2–1.5 Si, 0.15–0.3 N, 0.1–0.2 rare metal(s), 1–3 Nb, the balance Fe and unavoidable impurities.

An Al—Mn—Si—N austenitic stainless acid-resisting steel resistant to intergranular-corrosion according to one embodiment of the invention contains 0.06–0.12 C, 4–5 Al, 16–18 Mn, 1.2–5 Si, 0.15–0.3 N. 0.1–0.2 rare metal(s), 1–3 Ti, 1-3 Nb, the balance Fe and unavoidable impurities.

An Al—Mn—Si—N austenitic stainless acid-resisting steel according to one embodiment of the invention, which has an improved toughness at a low temperature, especially at −120° C., contains 0.06–0.12 C, 4–5 Al, 16–18 Mn, 1.2–1.5 Si, 0.15–0.3 N, 0.1–0.2 rare metal(s), 2–4 Ni, the balance Fe and unavoidable impurities.

An Al—Mn—Si—N austenitic stainless acid-resisting steel according to one embodiment of the invention, which has an improved toughness at a low temperature, especially at −120° C., contains 0.06–0.12 C, 4–5 Al, 16–18 Mn, 1.2–1.5 Si, 0.15–0.3 N, 0.1–0.2 rare metal(s), 3–5 Cr, the balance Fe and unavoidable impurities.

An Al—Mn—Si—N austenitic stainless acid-resisting steel according to one embodiment of the invention, which has an improved toughness at a low temperature, especially at −120° C., contains 0.06–0.12 C, 4–5 Al, 16–18 Mn, 1.2–1.5 Si, 0.15–0.3 N, 0.1–0.2 rare metal(s), 3–5 Cr, 2–4 Ni, the balance Fe and unavoidable impurities.

An Al—Mn—Si—N austenitic stainless acid-resisting steel according to one embodiment of the invention, which has an improved corrosion resistance in hydrochoric acid, diluted sulfuric acid, basic solution and seawater, contains 0.06–0.12 C, 4–5 Al, 16–18 Mn, 1.2–1.5 Si, 0.15–0.3 N, 0.1–0.2 rare metal(s), 0.5–1 V, the balance Fe and unavoidable impurities.

An Al—Mn—Si—N austenitic stainless acid-resisting steel according to one embodiment of the invention, which has an improved corrosion resistance in sulfuric acid or reductive medium, contains 0.06–0.12 C, 4–5 Al, 16–18 Mn, 1.2–1.5 Si, 0.15–0.3 N, 0.1–0.2 rare metal(s), 2–3 Cu, the balance Fe and unavoidable impurities.

An Al—Mn—Si—N austenitic stainless acid-resisting steel according to one embodiment of the invention, which can particularly improve corrosion resistance in sulfuric acid or reductive medium, contains 0.06–0.12 C, 4–5 Al, 16–18 Mn, 1.2–1.5 Si, 0.15–0.3 N, 0.1–0.2 rare metal(s), 1–3 Mo, the balance Fe and unavoidable impurities.

An Al—Mn—Si—N austenitic stainless acid-resisting steel according to one embodiment of the invention, which can particularly improve corrosion resistance in sulfuric acid or reductive medium, contains 0.06–0.12 C, 4–5 Al, 16–18 Mn, 1.2–1.5 Si, 0.15–0.3 N, 0.1–0.2 rare metal(s), 2–3 Cu, 1–3 Mo, the balance Fe and unavoidable impurities.

An Al—Mn—Si—N austenitic stainless acid-resisting steel according to one embodiment of the invention, which can further improve corrosion resistance, contains 0.06–0.12 C, 4–5 Al, 16–18 Mn, 1.2–1.5 Si, 0.15–0.3 N, 0.1–0.2 rare metal(s), 0.5–1 Zr, the balance Fe and unavoidable impurities.

An Al—Mn—Si—N austenitic stainless acid-resisting steel according to one embodiment of the invention, which can further improve corrosion resistance, contains 0.06–0.12

C, 4–5 Al, 16–18 Mn, 1.2–1.5 Si, 0.15–0.3 N, 0.1–0.2 rare metal(s), 0.5–1 Hf, the balance Fe and unavoidable impurities.

An Al—Mn—Si—N austenitic stainless acid-resisting steel according to one embodiment of the invention, which can further improve corrosion resistance, contains 0.06–0.12 C, 4–5 Al, 16–18 Mn, 1.2–1.5 Si, 0.15–0.3 N, 0.1–0.2 rare metal(s), 0.5–1 Zr, 0.5–1 Hf, the balance Fe and unavoidable impurities.

An Al—Mn—Si—N austenitic stainless acid-resisting steel according to one embodiment of the invention, which can improve resistances to oxidation, heat fatigue and hot corrosion, contains 0.06–0.12 C, 4–5 Al, 16–18 Mn, 1.2–1.5 Si, 0.15–0.3 N, 0.1–0.2 rare metal(s), 0.3–1 Co, the balance Fe and unavoidable impurities.

An Al—Mn—Si—N austenitic stainless acid-resisting steel according to one embodiment of the invetion, which can improve resistances to wear and high-temperature, contains 0.06–0.12 C, 4–5 Al, 16–18 Mn, 1.2–1.5 Si, 0.15–0.3 N, 0.1–0.2 rare metal(s), 0.2–0.8 W, the balance Fe and unavoidable impurities.

The choice of these elements in the Al—Mn—Si—N austenitic stainless acid-resisting steels and content ranges thereof are based on the reasons below:

A certain quantity of Al can provide steel with corrosion resistance and improve its toughness at a low temperature and oxidation resistance. However, on one hand, when the content of Al is below 4 (wt.) %, the corrosion resistance of the steel is not significant, on the other hand, when the content of Al increases, the corrosion resistance will improve while the steel is ready to fracture during forge and roll, thereby resulting in a poor heat processing property. Therefore, preferred is the content of Al 4–5%.

The element Mn has an ability to enlarge austenitic area and stabilize austenite. However, this ability is about a half of that of Ni. Therefore, the content of Mn is limited to 16–18%.

Si can react to produce a compact $SiO_2$ film on the surface of steel, which can prevent acids from further erosion to the interior of steel and is specially effective to improve corrosion resistance of steel in a high concentration of nitric acid. However, when the content of Si is too high, it will make the steel deform difficult. Therefore, the content of Si is limited to 1.2–1.5 (wt.) %.

N can impart steel corrosion resistance while facilitate formation of austenite strongely so that it can partly substitute for Ni.

Mo and Cu can further improve corrosion resistance of steel in sulfuric acid or reductive medium. When steel contains a certain quantity of Mo and Cu, the corrosion resistance will be more significant.

Nb and Ti can react with C in the steel to produce a stable carbide. In the case that it is required to restrain intergranular corrosion strictly, a certain quantity of Nb and/or Ti can be added to steel.

Zr and Hf can be resistant to intergranular corrosion. If it is required to confine intergranular corrosion more strictly, a certain quantity of Zr and/or Hf can be added to steel.

V in the steel can be resistant to corrosion in hydrochoric aicd, diluted sulfuric acid, basic solution and seawater.

If a certain quantity of Co is included in steel, it can improve its resistances to oxidation, heat fatigue and hot corrosion.

In order to improve resistances to wear and high temperature, a certain quantity of W can be added to the steel.

Rare metal(s) can improve the corrosion resistance and oxidation resistance of steel, refine its crystal grain and upgrade the steel, thereby improving its processing property.

It can follow from the following examples that the Al—Mn—Si—N austenitic stainless acid-resisting steel according to the invention is better than traditional 18-8 type Cr-Ni stainless steel in terms of corrosion resistance, heat processing property, welding performance and combined mechanic properties. Because the expensive and scarce Cr and Ni are substituted with the elements which are inexpensive and ready to obtain such as Al, Mn, Si, N, the price of the steel of the invention is far below that of 18-8 type Cr-Ni stainless steel.

The Al—Mn—Si—N austenitic stainless acid-resisting steel of the invention can be smelt with conventional electric-arc furnace and induction furnace so as to be cast into steel ingot and made into a variety of stainless steel products in needed shape by conventional processing technique such as hot rolling, forging, cold rolling draw(draft).

This invention can be further illustrated by the following examples.

EXAMPLE

The process of smelting is carried out in a half-ton three-phase electric-arc furnace. 10 kg Al ingot, 36 kg Mn, 3 kg crystalline Si, 1 kg $Cr_2O_3$ are introduced sequently into the bottom of the furnace with a good liner, then a clean rust-free liquid steel, which contains less 0.12% carbon and has a size of about 100 mm, is added so as to cover the materials above. Turn on tie power to melt these materials into a liquid. After the liquid becomes clear, a sample is taken for analysis. Adjust slag to keep the liquid good flowable. When the temperature of the liquid is higher than 1500° C., select a redutive slag to carry out reductive reaction for 20 min. When the temperature of the liquid of steel is 1540–1560° C., 0.5 kg mixed rare metals is added therein. After fill agitation, discharge the steel. The composition of the steel is shown as table 1.

TABLE 1

| Element | C | Si | Mn | N | Al | RE |
|---|---|---|---|---|---|---|
| Content (wt. %) | 0.07 | 1.25 | 16.30 | 0.17 | 4.38 | 0.17 |

The mechanical properties of the steel are shown as table 2.

TABLE 2

| The invention | σ 0.2 (MPa) 250 | σ b(MPa) 550 | σ s(%) 54 |
|---|---|---|---|
| 1Crl8Ni9 GB3280-92 | ≧205 | ≧520 | ≧40 |

The corrosion resistance: its weight is reduced by 9.817 g after the steel is subjected to a corrosion test in 5% sulfuric acid (boiling) for half an hour, which is far below the value stipulated by the China National Standard.

What is claimed is:

1. An Al—Mn—Si—N austenitic stainless steel having the following elements (wt. %): 0.06–0.12 C, 4–5 Al, 16–18 Mn, 1.2–1.5 Si, 0.15–0.30 N, 0.1–0.2 rare metal(s), the balance Fe and unavoidable impurities.

2. The Al—Mn—Si—N austenitic stainless steel according to the claim 1, which further contains 1–3 Ti.

3. The Al—Mn—Si—N austenitic stainless steel according to the claim 1, which further contains 1–3 Nb.

4. The Al—Mn—Si—N austenitic stainless acid-resisting steel according to the claim 1, which further contains 2–4 Ni.

5. The Al—Mn—Si—N austenitic stainless acid-resisting steel according to the claim 1, which further contains 3–5 Cr.

6. The Al—Mn—Si—N austenitic stainless acid-resisting steel of the claim 1, which further contains 0.5–1 Zr.

7. The Al—Mn—Si—N austenitic stainless acid-resisting steel of the claim 1, which further contains 0.5–1 Hf.

8. The Al—Mn—Si—N austenitic stainless acid-resisting steel of the claim 1, which further contains 0 5–1 V.

9. The Al—Mn—Si—N austenitic stainless acid-resisting steel of the claim 1, which further contains 0.3–1 Co.

10. The Al—Mn—Si—N austenitic stainless acid-resisting steel of the claim 1, which further contains 0.2–0.8 W.

11. The Al—Mn—Si—N austenitic stainless acid-resisting steel of the claim 1, which further contains 2–3 Cu.

12. The Al—Mn—Si—N austenitic stainless acid-resisting steel of the claim 1, which further contains 1–3 Mo.

* * * * *